United States Patent [19]

Kennedy, Jr. et al.

[11] 4,013,880

[45] Mar. 22, 1977

[54] BREATH GUARD CANOPY FOR SERVING UNIT

[75] Inventors: Robert J. Kennedy, Jr.; Kendall S. Smith, II, both of West Lafayette, Ind.

[73] Assignee: Lincoln Manufacturing Company, Inc., Fort Wayne, Ind.

[22] Filed: Dec. 8, 1975

[21] Appl. No.: 638,969

[52] U.S. Cl. ..... 240/2 AD; 240/6; 248/220.2; 312/140.4; 312/223

[51] Int. Cl.[2] ..... A47F 11/10; A47F 3/00

[58] Field of Search ..... 240/2 AD, 2 V, 51.1 R, 240/47, 2 W, 6, 2 PA; 248/223; 312/140.4, 140.1, 137, 209, 223, 284; 126/268, 213; 186/1 R

[56] References Cited

UNITED STATES PATENTS

| | | | |
|---|---|---|---|
| 1,790,383 | 1/1931 | Kuehn | 240/6 |
| 2,158,420 | 5/1939 | Hagelin et al. | 240/6 |
| 2,174,983 | 10/1939 | Kennedy | 240/6 |
| 3,026,162 | 3/1962 | Waszkiewicz | 312/140.4 |
| 3,516,634 | 6/1970 | Salava et al. | 248/223 |
| 3,847,250 | 11/1974 | Sherrill | 312/140.4 |

*Primary Examiner*—Edna M. O'Connor
*Attorney, Agent, or Firm*—Albert L. Jeffers; Roger M. Rickert

[57] ABSTRACT

A breath guard canopy for a serving unit of the type in which individuals move trays along one or both sides of the serving unit and receive food stuffs therefrom either by self-service or by being served. A breath guard, or canopy, in the form of at least one sheet of transparent material is supported on the unit in such a position as to be interposed between individuals moving along the unit and food stuffs contained in the unit, thereby protecting the food stuffs from the possibility of contamination. An illumination unit may be incorporated in the canopy to illuminate such foodstuff.

11 Claims, 5 Drawing Figures

BREATH GUARD CANOPY FOR SERVING UNIT

The present invention relates to a protective guard, or shield, arrangement, especially for use in connection with serving units in which food stuffs are displayed and along which individuals that are to receive the food stuffs move.

The serving of food from serving units along which individuals can move while carrying trays, or sliding trays along a tray support, are known and are widely used in connection with cafeterias and in institutions and in respect of banquets and the like. Such an arrangement permits large numbers of people to be served without requiring a great many attendants and while the food stuff being served is maintained at proper serving temperature.

It is, however, objectionable for such units to have the food stuffs therein exposed in such a manner that the possibility exists that the food stuff could become contaminated from the breath of an individual passing along the unit for being served therefrom, or for taking food therefrom.

It is usually the case that transparent guarding, or shielding, arrangements are arrived at in order to isolate the food stuff from the individuals moving along the unit and such arrangements can take many forms with the shielding element per se being formed of glass, or transparent plastic.

It is in connection with a breath guard canopy, or device, of the nature referred to above that the present invention is concerned.

A primary object of the present invention is the provision of a breath guard canopy, or device, of the nature referred to above which is relatively inexpensive but highly effective.

Another object of the present invention is the provision of a breath guard device of the nature referred to which can be erected and dismantled substantially without the use of tools and which can readily be cleaned and maintained in a sanitary condition at all times.

A still other object of the present invention is the provision of a breath guard device of the nature referred to which meets all sanitary specifications.

A still further object of the present invention is the provision of a breath guard device of the nature referred to which is attractive in appearance.

BRIEF SUMMARY OF THE INVENTION:

According to the present invention a food serving unit, or module, or the like, is provided with longitudinally spaced upstanding pylons, and extending between the pylons near the top are interconnecting rail members so that the pylons and rail members form a substantially rigid structure.

On the inner side of each of the pylons, there is mounted a generally triangular support member and resting on top of the triangular support members at each side of the unit is a sheet of transparent plastic material forming a shield or guard, the ends of which are supported on the triangular support members, while the upper edge of which is retained by spring clip elements.

Extending between the pylons and in about the center thereof near the top is fluorescent lighting means, the opposite ends of which are mounted in appropriate socket elements carried by the respective pylons. A cover member is provided which is substantially in the form of an inverted U-shape and which snaps over the aforementioned rail members which extend between the pylons from above. The ends of the cover member preferably rest on top of fittings which are secured to the inner sides of the pylons and which support the sockets for the fluorescent lighting means.

Advantageously, the triangular support members referred to are retained in position by finger removable nuts so that no tools are required to disassemble the structure for cleaning purposes.

For an elongated unit, it may be advisable to provide an additional triangular support member in about the center of the length of the unit for additional support for the transparent guard, or shield, elements.

The exact nature of the present invention will become more apparent upon reference to the following detailed specification taken in connection with the accompanying drawings in which.

DETAILED DESCRIPTION OF THE INVENTION

Figure 1:
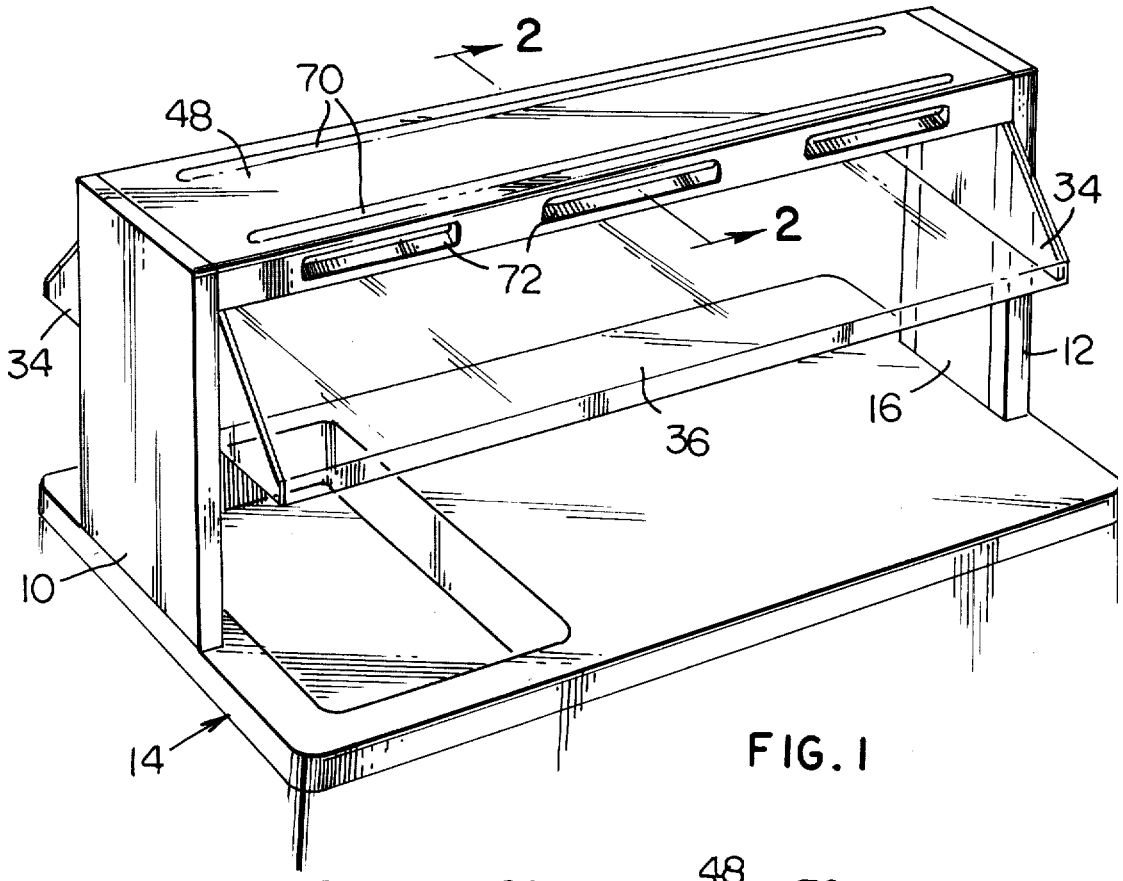
FIG. 1 is a perspective view showing an arrangement according to the present invention in fully assembled relation.
Figure 2:
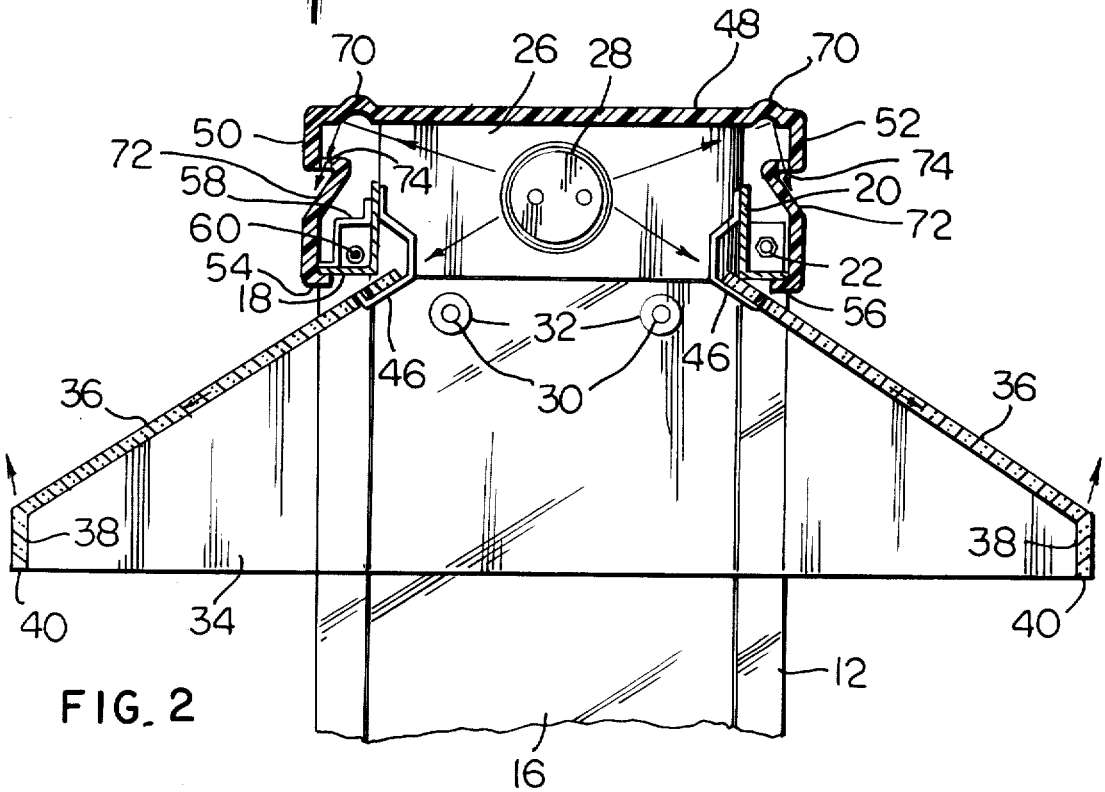
FIG. 2 is a vertical transverse sectional view indicated by line II—II on FIG. 1.
Figure 3:
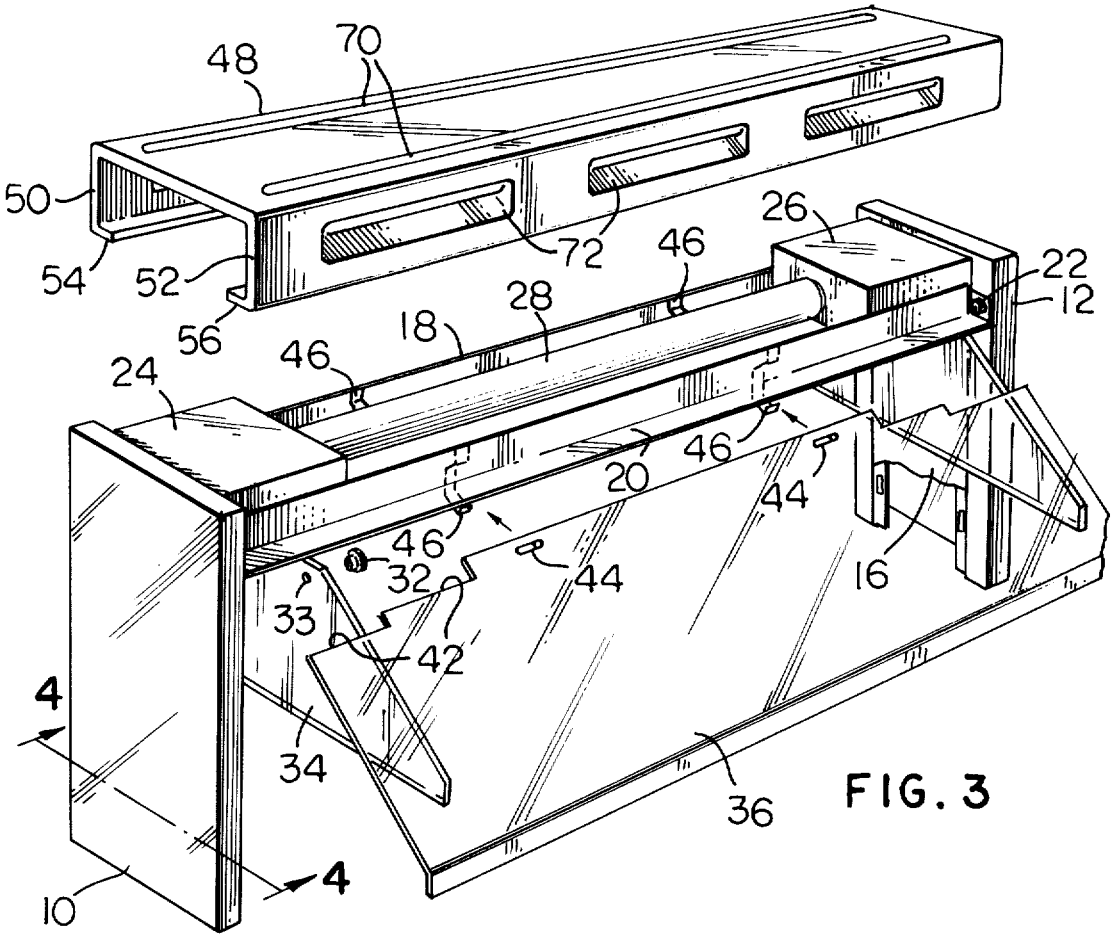
FIG. 3 is an exploded view showing the various parts of a breath guard unit, or canopy, according to the present invention prior to assembly.

Referring to the drawings somewhat more in detail, FIGS. 1, 2 and 3 disclose the breath guard, or shield, device or canopy, according to the present invention. In these views, it will be seen that a pair of upstanding pylons 10 and 12 are provided which, at the lower ends are fixedly supported on the upper side of a unit at the ends. Unit 14 may be any of the several types which are employed for serving food stuffs. The unit 14 may have wells therein which are heated for holding hot food stuffs, or the food stuffs contained in unit 14 may be refrigerated, or at room temperature.

The pylons 10 and 12 may be permanently attached at the lower ends thereof to unit 14, or may be detachably secured thereto. The pylons 10 and 12 are formed of stainless steel and each has a closure panel 16 mounted on the inner side thereof, only one of which will be seen in FIG. 1, and details of which will be described in connection with FIGS. 4 and 5.

Near the upper ends, the pylons are connected by rail members 18 and 20 in the form of angles which extend horizontally between the pylons and which may be connected to the respective pylons as by threaded means such as are indicated at 22 in FIG. 2.

Adjacent the upper end of each pylon on the inside there is mounted a box-like member 24 on pylon 10 and a box-like member 26 on pylon 12. Each of these box-like members projects toward the other thereof and on the sides facing each other, the members 24 and 26 have socket means for receiving fluorescent lighting means such as is indicated by tube 28 in FIGS. 2 and 3. Members 24 and 26 may, for example, include the fluorescent lighting means ballast.

Projecting from the panels 16 on the inner sides thereof, and immediately therebeneath the respective box-like members 24 and 26, are laterally spaced studs 30 which are provided with knurled finger nuts 32. The studs are provided for being received in holes 33 near the top edges of the generally triangularly shaped end support members 34 which may be formed of a suitably strong material, such as plexiglass, or the like.

Figure 4:
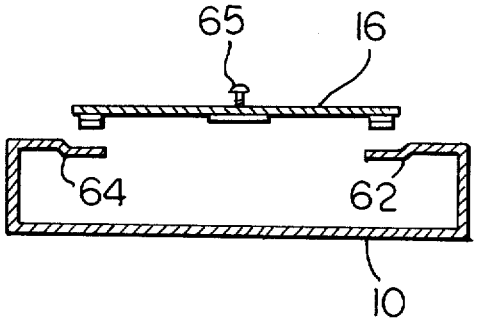
FIG. 4 is a plan section through one of the pylons which upstand from the serving unit and form the support of the breath guard device or canopy.

A support member 34 is provided on the inner side of each of the pylons and provides means for supporting the transparent guard, or shield, elements 36 which may also be formed of plexiglass. Each guard element 36 is inclined outwardly and downwardly at an angle of about 60° from vertical. The upper edge of each guard element 36 is notched as at 42 to permit the respective element to fit about the box-like members 24 and 26. Adjacent the upper edge of each of the elements 36 there are formed apertures 44 and which apertures, as will be seen in FIGS. 2 and 4, are adapted for being engaged by the free ends of angular spring clips 46 which may be welded, or otherwise suitably affixed to the respective rail 18 and 20.

It will be noted that the extreme upper edges of the elements 36 are held captive between the lower inner corners of the angles 18 and 20 and the spring clips 46, while the shield elements are detachable from the spring clips by lifting the element 36 upwardly to a substantially horizontal position and applying a small force outwardly. The guard elements 36, can, thus, easily be put in place or removed for cleaning.

A canopy according to the present invention is also provided with a cover member 48 extending longitudinally of the canopy assembly and at the opposite ends resting on top of the box-like members 24 and 26 and having side legs 50 and 52 extending downwardly and having inturned lower edges 54 and 56 which snap beneath the outer ends of the lower legs of angles 18 and 29.

One of the angles, such as angle 18, has an angular element 58 thereon forming a channel through which wires 60 can be led. These wires are employed for energizing the fluorescent light means, or for other purposes, and may be brought up through either one or both of the pylons and run between the box-like members 24 and 26 along the channel described above.

Figure 5:
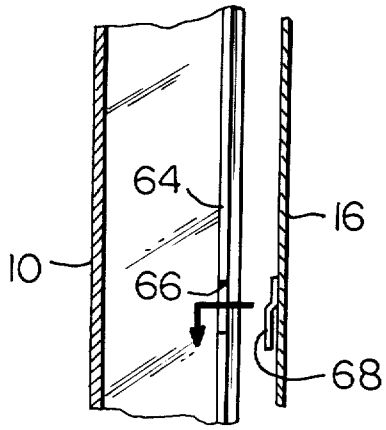
FIG. 5 is a fragmentary view in the form of a vertical section through one of the pylons showing the manner in which a cover sheet can be attached to the inner side thereof.

As will be seen in FIGS. 4 and 5, each of the pylons comprises a generally U-shaped strip of stainless steel having the ends of the legs bent inwardly as at 62 in FIG. 4 which is a plan sectional view taken through pylon 10. The extreme inner ends of the turned in legs 62 and 64 are offset inwardly of the respective pylons to form a seat for receiving the respective closure panel 16. The inwardly offset portions of the legs may be apertured, or notched, as at 66 in FIG. 5 and the panel 16 may have clips 68 fixed to the inside thereof, as by spot welding, for example, which are engageable with the apertures, or notches 66, formed in the inset portion of the turned in legs of the respective pylons.

Notches 66 and clips 68 are advantageously near the lower ends of the pylons and each panel 16 may be held in place at the upper end by a screw extending into, for example, a flange formed on the bottom of the respective one of the box-like members 24 and 26.

It will be apparent that the box-like members 24 and 26 are set downwardly from the extreme upper edges of the pylons 10 and 12, as will be seen in FIG. 3, so that the ends of cover member 48 abut the inner sides of the pylons and are located thereby.

As will be seen in FIG. 2, the cover member 48 may have upstanding laterally spaced longitudinal ribs formed thereon at 70 which are parallel to the side edges of the cover member and which terminate a short distance inwardly from the ends of the cover member. The upstanding ribs can provide means for slidably supporting the tray or, more likely, for confining dishes or the like which may be set on top of the cover member.

The cover member is provided along each side with indented portions 72 and apertures 74 are provided in the upper regions of the indented regions so that light from lighting means 28 will be reflected outwardly through the apertures and illuminate the members 36 and the sides of cover member and thereby improve the appearance of the canopy arrangement.

Illumination from lighting means 28 also falls on the upper inner edges of the guard elements 36 and, depending on the particular material employed for the shield members, may provide a region of illumination along the lower outer edges of the guard elements to make the guard elements more readily discernable.

With an elongated serving arrangement, there may be provided an additional one of the support members 34 midway of the length of the unit and such an additional support member can advantageously be connected to brackets secured to the angles 18 and 20 and having studs to engage the holes in the support members near the upper edge thereof.

It will be appreciated that a breath guard canopy according to the present invention is strong but relatively inexpensive, can easily be disassembled for cleaning purposes without special tools, and is highly effective for the intended purpose.

Modifications may be made within the scope of the appended claims.

What is claimed is:

1. A breath guard canopy comprising; spaced support members, means supporting said support members, at least one transparent guard element extending between and resting on said support members and inclining downwardly toward one edge, aperture means formed in said guard element near the other edge, and spring clip means engageable with said aperture means for releasably holding said guard element in place on said support members.

2. A breath guard canopy according to claim 1 which includes spaced upstanding pylons forming the means supporting said support members, rails extending horizontally between and connected to said pylons, said spring clips being connected to said rails, and a cover member extending between said pylons at the top and engaging said rails.

3. A breath guard canopy according to claim 2 in which each pylon is in the form of an inwardly opening vertically extending channel, and cover plates releasably mounted on the open inner side of each said channel.

4. A breath guard canopy according to claim 2 in which each support member is a generally triangularly shaped transparent member with a lower edge extending horizontally and with side edges extending upwardly and inwardly from the extremities of said lower edge, a pair of laterally spaced apertures near the top of each support member, each pylon having threaded studs on the inner side receivable in said apertures for supporting the respective support member, and finger nuts threaded on said studs.

5. A breath guard canopy according to claim 2 which includes means on said rails intermediate the ends thereof for supporting a further support member.

6. A breath guard canopy according to claim 2 in which each rail is an angle with a vertical leg and a horizontal leg extending outwardly from the bottom of the vertical leg, each said spring clip being connected to the inside surface of the vertical leg of the respective rail and having a resilient free end extending angularly downwardly and outwardly beneath the horizontal leg and having an upwardly end part for engagement with the corresponding aperture in the respective guard element, the edge of the guard element near the aperture being disposed between the spring clip and the corner formed on the angle at the juncture of the legs of the angle.

7. A breath guard canopy according to claim 1 which includes spaced upstanding pylons forming the means supporting said support members, rails extending horizontally between and connected to said pylons, illuminating means extending horizontally between the pylons near the upper ends thereof for illuminating the space beneath the canopy, and a cover member in the form of a downwardly opening channel extending horizontally between said pylons at the upper ends thereof and engaging said rails, said cover member enclosing said illuminating means along the sides thereof.

8. A breath guard canopy according to claim 7 in which said cover member includes indentations in the sides thereof and apertures in the upper sides of said indentations through which light from said illuminating means can pass and through which heated air can escape from inside the cover member.

9. A breath guard canopy according to claim 7 in which said cover member is flat on top and is formed with upstanding ribs extending longitudinally thereof in laterally spaced relation.

10. A breath guard canopy according to claim 7 in which said pylons include means on the inner sides near the top for engaging the underside of said cover member at the ends, said rails having laterally outwardly projecting legs, the lower ends of the sides of said cover member being formed inwardly and snapping over said legs when the cover member is put in place on the canopy.

11. A breath guard canopy according to claim 1 in which the outer edge of the guard element is angled downwardly from the plane of the guard element to impart against bending to the guard element.

* * * * *